United States Patent [19]

Heinrich

[11] 4,322,912

[45] Apr. 6, 1982

[54] SAFETY DEVICE FOR A VEHICLE DOOR ACTUATED BY A TURNABLE SHAFT

[75] Inventor: Siegfried Heinrich, Edermunde, Fed. Rep. of Germany

[73] Assignee: Gebr. Bode & Co., Kassel, Fed. Rep. of Germany

[21] Appl. No.: 125,757

[22] Filed: Feb. 29, 1980

[30] Foreign Application Priority Data

Jul. 13, 1979 [DE] Fed. Rep. of Germany ..... 2928315

[51] Int. Cl.[3] ..... E05F 15/02

[52] U.S. Cl. ..... 49/28; 49/338; 49/340; 49/344

[58] Field of Search ..... 49/26, 28, 338, 344, 49/340

[56] References Cited

U.S. PATENT DOCUMENTS 2,578,810 12/1951 Kilar et al. ..... 49/26 X 2,795,414 6/1957 Wise ..... 49/338 X

FOREIGN PATENT DOCUMENTS 842800 3/1939 France ..... 49/340

*Primary Examiner*—Kenneth Downey

*Attorney, Agent, or Firm*—Hane, Roberts, Spiecens & Cohen

[57] ABSTRACT

A safety device for a vehicle door of the type actuated by a turnable shaft driven by a piston cylinder unit having a piston rod connected by a hinge bolt to a lever arm fixedly mounted on the turnable shaft. The safety device comprises a carrier coupled to the lever arm and slidably receiving the piston rod, a switch element on the carrier and a control element on the piston rod. When the door encounters an obstacle, the control element is brought into contact with the switch element to reverse the direction of movement of the door.

10 Claims, 2 Drawing Figures

SAFETY DEVICE FOR A VEHICLE DOOR ACTUATED BY A TURNABLE SHAFT

FIELD OF THE INVENTION

The invention relates to a safety device (anti-clamping device) for a vehicle door actuated by a turnable shaft which is driven by a piston and cylinder unit, the piston rod of which is connected via a hinge bolt to a lever arm which is fixedly mounted on the turnable shaft.

PRIOR ART

As is known, an anti-clamping device for a vehicle door operates to reverse the direction of travel of the door leaf if in the range of movement of the door leaf an obstacle is encountered, for example, if a person enters when the door leaf is already moving towards closed position and the person could thus be clamped in the door.

Anti-clamping devices are known which operate by pneumatic means. Thus, if an obstacle exerts a pressure upon the pneumatic system, a reversal of movement is effected, as a result of which the door leaf carries out a correspondingly reverse movement.

Such anti-clamping devices operating on a pneumatic basis are, however, dependent on atmospheric conditions to a certain extent, because if the temperature rises or drops, the pressure in the pneumatic system also changes so that the response of the anti-clamping arrangement varies. Such arrangements are therefore not always functionally reliable.

SUMMARY OF THE INVENTION

An object of the invention is to provide an anti-clamping device for a vehicle door, which is independent of temperature and which can be installed outside the finger-protecting strip of the door leaf.

According to the invention, this is achieved in that a carrier for a switch element is associated with the piston rod of the piston-cylinder drive and the piston rod is movable relative to the carrier and carries the control element for the switch element.

According to a preferred embodiment, the carrier comprises a sleeve concentric with the piston rod and supported on the hinge bolt. A spring is arranged concentrically on the piston rod and bears, on the one hand, on the piston rod and, on the other hand, on the sleeve, the switch element being provided on the sleeve.

In a specific arrangement, the piston rod has an end with an elongated hole loosely receiving the hinge bolt to permit the relative movement; also, the sleeve body is provided with an elongated hole loosely receiving the control element.

When the door leaf carries out the closing movement and in so doing encounters an obstacle, then the piston and cylinder drive has the tendency to continue to pull its piston rod in the pulling direction for the closure movement, while the lever arm, due to the obstacle, is not capable of performing any movement. As a result of this, the piston rod performs a movement relative to the carrier which is constructed as a sleeve.

Since the control element is provided on the piston rod, the control element thus engages the switch element which is provided on the sleeve and effects the motion reversal.

The location of the spring between the sleeve and the piston rod assures that the piston assumes the initial position with respect to the sleeve.

DETAILED DESCRIPTION

Figure 1:
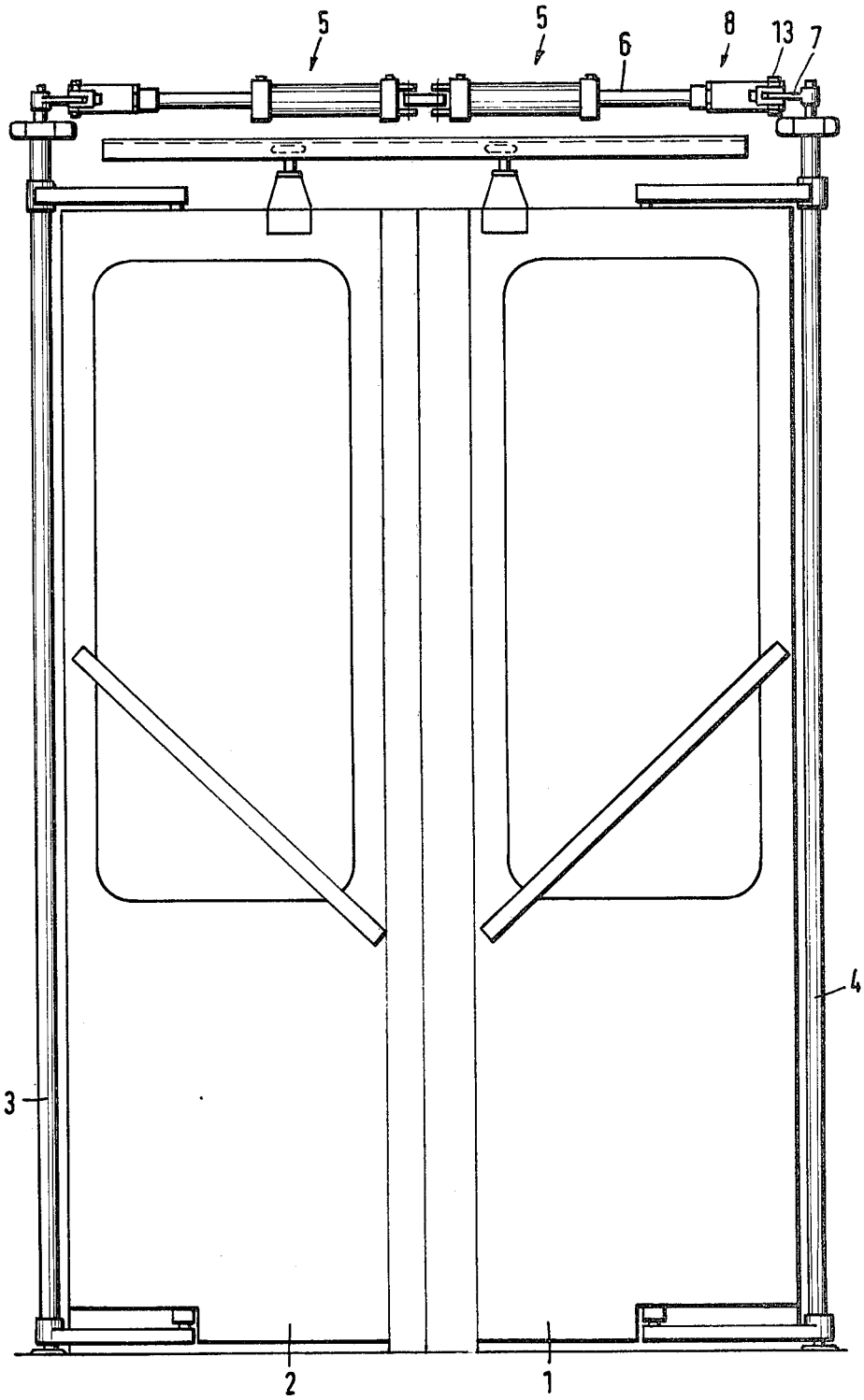
FIG. 1 is an elevational view of a vehicle door with the piston and cylinder unit at the top and provided with the anti-clamping device according to the invention.

FIG. 1 shows the door of a vehicle which comprises door leaves 1 and 2 which are actuated in known manner by turnable shafts 3 and 4, respectively.

Figure 2:
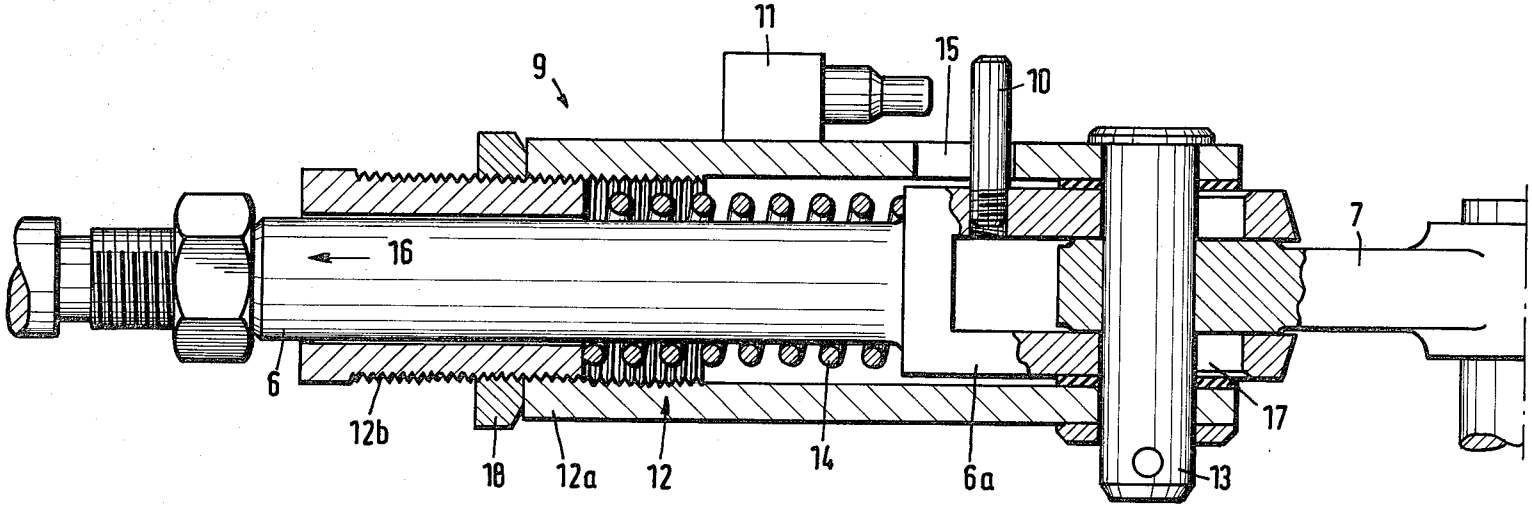
FIG. 2 is an enlarged sectional view showing the details of the anti-clamping device.

The drive of each shaft is effected by a piston-cylinder drive 5 whose piston rod 6 is connected to the turnable shaft via a lever arm 7 which is fixedly mounted on the turnable shaft. A pivotable connection is made between the piston rod 6 and the lever arm 7 by a pivot or hinge bolt 13. An anti-clamping device 8 is associated with the piston rod and the lever arm and is illustrated in detail in FIG. 2.

The anti-clamping device 8 comprises a carrier 9 slidably receiving the piston rod 6 and engaging the hinge bolt 13. Mounted on the piston rod 6 is a control element 10 and mounted on the carrier 9 is a switch element 11.

The construction is such that the carrier 9 is formed as a sleeve 12 which is concentric with the piston rod 6. The sleeve 12 is supported on the hinge bolt 13 which connects the piston rod 6 with the lever arm 7 with play. More particularly, the end **6*a* of the piston rod is constituted as a forked head provided with elongated holes 17 permitting relative movement between bolt 13 and piston 6**.

A spring 14 is engaged at one end with the sleeve 12 and at the other end with the forked head **6*a* of the piston rod 6. An elongated hole 15 is provided in the sleeve 12 to loosely receive the control element 10 and permit relative movement between element 10 and carrier 9**.

During closing movement of the door leaf, the associated piston rod undergoes a movement in the direction of the arrow 16.

If, during this movement, the door leaf encounters an obstacle, then the lever arm 7 can not participate in this movement, and it has the tendency to retain the piston rod. In this case, however, the piston rod can still undergo movement due to the elongated holes 17. During this movement, the control element 10 contacts the switch element 11 and controls a circuit which produces a direction reversal of the door leaf.

For purposes of adjustability of the tension of the spring 14, the sleeve is composed of threaded sleeve sections **12*a* and 12*b*. The sleeve 12*b*, against which the spring 14 is engaged is threaded into the sleeve section 12*a* and can be adjusted as regards its depth of threaded engagement to adjust the initial tension in the spring. A counter nut 18 serves to lock the two sleeve sections 12*a* and 12*b***.

Not only can the spring tension be varied by the two sleeve sections **12*a*, 12*b***, but it is also possible to compensate for friction of the bearings of the turnable shaft.

As seen from the above, there is provided a safety device according to the invention which comprises a switch means actuable when the door encounters an obstacle and is prevented from closing whereby the door is driven in opposite direction. The switch means comprises the carrier 9 coupled to the lever arm 7 and slidably receiving the piston rod, switch element 11 and control element 10 for operating the switch element.

Although the invention has been disclosed in conjunction with a specific embodiment thereof, it will become evident to those skilled in the art that numerous modifications and variations can be undertaken within the scope and spirit of the invention as defined in the attached claims.

What is claimed is:

1. A safety drive apparatus for a vehicle door of the type actuated by a turnable shaft driven by a piston-cylinder unit having a piston rod, said drive apparatus comprising a lever arm fixedly mounted on the turnable shaft, a hinge bolt connected to said arm, a carrier connected to said hinge bolt and coupled thereby to said arm, said piston rod being connected with play to said hinge bolt and being slidable with respect to said carrier to enable said carrier and said piston rod to move relative to one another while being separately connected to said hinge bolt, switch means actuable when the door encounters an obstacle and is prevented from closing, said switch means comprising a switch element and a control element for operating said switch element, said carrier supporting one of said elements, said piston rod supporting the other of said elements.

2. A safety drive apparatus as claimed in claim 1 wherein said carrier comprises a sleeve concentrically mounted on the piston rod and connected to said bolt, and a spring concentrically mounted on the piston rod and bearing, on the one hand, on the piston rod and, on the other hand, on the sleeve to bias said sleeve and rod to an initial position in which the switch element and control element are spaced from one another.

3. A safety drive apparatus as claimed in claim 2 wherein said switch element is on said sleeve.

4. A safety drive apparatus as claimed in claim 3 wherein said piston rod has an elongated hole loosely receiving said hinge bolt to provide the play between the rod and bolt.

5. A safety drive apparatus as claimed in claim 3 wherein said sleeve is provided with an elongated hole loosely receiving said control element.

6. A safety drive apparatus as claimed in claim 3 wherein said sleeve comprises two threaded sleeve sections one of which serves as an abutment for said spring.

7. A safety drive apparatus as claimed in claim 3 wherein said piston rod includes a forked end, said control element being secured to said forked end and extending with play through an elongated hole in said sleeve.

8. A safety drive apparatus as claimed in claim 7 wherein said control element is threaded in said forked end.

9. A safety drive apparatus as claimed in claim 7 wherein said forked end embraces said lever arm and has aligned, elongated holes loosely receiving said hinge bolt.

10. A safety drive apparatus as claimed in claim 9 wherein said spring bears against said forked end.

* * * * *